United States Patent [19]

Wiseman

[11] 4,171,603

[45] Oct. 23, 1979

[54] GUIDE MECHANISM FOR LOADING WIDE MOUTH BOTTLES IN CASES

[75] Inventor: John A. Wiseman, Lynchburg, Va.

[73] Assignee: Simplimatic Engineering Co., Lynchburg, Va.

[21] Appl. No.: 927,371

[22] Filed: Jul. 24, 1978

[51] Int. Cl.[2] ..... B65B 39/02

[52] U.S. Cl. ..... 53/248; 53/261

[58] Field of Search ..... 53/539, 246, 247, 248, 53/260, 261, 262; 193/32, 40

[56] References Cited

U.S. PATENT DOCUMENTS

| | | | |
|---|---|---|---|
| 2,277,688 | 3/1942 | Cattonar et al. | 53/539 X |
| 3,031,005 | 2/1936 | Renfroe | 53/248 X |

*Primary Examiner*—Travis S. McGehee

*Attorney, Agent, or Firm*—James & Franklin

[57] ABSTRACT

In a case packer, wide mouth bottles are conveyed to a platform where they are arranged in alignment with the cells in the case and thereafter held in position by suction cups. The platform is rotated to suspend the bottles, mouth down, over the case. The bottles are gravity fed into cells in the case formed by upstanding partitions. A guide mechanism is interposed between the platform and the case to correct misalignment of the partitions and to guide the bottles into the cells. The guide mechanism includes, for each cell, a pair of rigid guide members aligned with opposing corners of the cell. The guide members are pivotally mounted to a grid, in opposing spaced relationship, such that the members are movable between a closed, closely opposed and preferably mutually engaging position, inclined towards one another, and an opened mutually separated, generally vertical position. Each member includes first and second sections. The first section has an interior surface which engages the corresponding surface on the opposing member, when the members are in the closed position, to form a solid pyramidal shaped structure, which is received in the cell, to correct misalignment of the partitions, prior to releasing the bottles from the platform. The structure has a relativey sharp point greatly facilitating the correction of the position of grossly misaligned partitions. The second section, which has a concave inner surface corresponding to the curvature of the bottle wall, serves to guide the bottle into the cell as it is released from the platform. As the bottle travels between the opposing second sections of the member pair, the members move to the open position, causing same to further position the partitions. Each member has a pair of exterior surfaces joined to form an edge. The edge is adopted to be received in the corner of the cell when the member is received therein.

34 Claims, 10 Drawing Figures

GUIDE MECHANISM FOR LOADING WIDE MOUTH BOTTLES IN CASES

The present invention relates to case packers for loading bottles and the like into cells in a case formed by upstanding partitions and, more particularly, to a guide mechanism therefor which serves to correct misalignment of the partitions forming the cell and to guide the bottles into the cells.

Case packers, of the type herein under discussion, normally include a bottle conveying apparatus, in the form of a conveyer belt or the like, designed to provide a continuous stream of bottles for loading a two-sided rotatable platform. The bottles are fed to the upper surface of the platform with the mouths thereof facing upward. Means, such as suction cups, are provided on the surface of the platform such that each bottle, when it is properly positioned on the platform, is aligned with one of the suction cups. The suction cups are then actuated by connecting same to a vacuum such that the bottoms of the bottles are engaged. The platform is then rotated such that the bottles are suspended from the platform with the mouths thereof in the downward facing position.

A case or carton having a plurality of cells therein, formed by upstanding interlocking partitions, is positioned underneath the platform such that each cell therein is aligned with a different one of the bottles suspended from the platform. The bottles are gravity fed from the platform to the case as they are released by the suction cups. Because the partitions in the case are often not initially positioned correctly to form cells of the required dimensions, misalignment of the partitions must be corrected if the bottles are to be inserted in the cells. Positioning of the partitions and guiding of the bottles therein is achieved by a guide mechanism interposed between the platform and the case. The guide mechanism positions the cell partitions such that same do not obstruct the path through which the bottles move and further provides a funnel-type structure to guide the bottles into the cells. The case is vertically movable with respect to the guide mechanism so as to permit the guide mechanism to interact with the cell partitions to properly position same and to reduce the distance through which the bottles must fall after they are released from the platform.

While the bottles on the underside of the platform are being loaded into a case, the bottle conveying apparatus is supplying bottles to the topside of the platform. Once the bottles have been released from the underside of the platform and the topside of the platform is fully loaded, the suction cups on the top side of the platform are actuated and the platform is rotated such that the newly loaded set of bottles are suspended, mouth down, over the case. The suction cups are deactuated and the bottles fall into the waiting case. Thus, the bottles are being loaded onto one side of the platform as they are released into the case from the other side of the platform, thereby substantially increasing the speed of the bottle packing operation. After each case is loaded, it is moved downwardly with respect to the guide mechanism and transferred to the output side of the case packer, such that it can be loaded on a pallet or the like for storage or shipment. At the same time, an empty case is conveyed to a position below the guide mechanism and is thereafter lifted onto the loading position.

Conventional guide mechanisms include a support grid with openings therein aligned with the cells in the case such that the bottles, once released from the support, can pass through the respective openings and into the cells. Because the upstanding partitions which form the cell walls are often initially misaligned with respect to each other, it is necessary that the guide mechanism serve to properly position the partitions to permit insertion of the bottles therein. If the partitions which form the cell walls are not properly positioned, the rim of the bottle, as same is dropped from the platform, may contact the upper edge of one of the partitions, either preventing the bottle from being inserted into the cell, or crushing the partition—which is normally made of relatively thin corrugated paperboard or the like. These conditions are intolerable because same may result in an improperly packed case and/or loose bottles which must be manually removed from the line, and/or a piece of the partition being situated within the bottle.

In order to correct misalignment of the partitions which form the cell walls and to guide the bottles therein, guide members, commonly referred to as "fingers" because of their elongated structure, are mounted on the support grid such that they extend downwardly therefrom towards the case. The fingers are either flexible and fixedly mounted to the support grid or rigid and pivotally mounted in a spring loaded manner to the support grid, such that same are movable from a normally closed position to an open position as the bottle moves therebetween.

In conventional mechanisms, for each cell in the case, four fingers are provided, each finger being mounted on the support grid such that it is aligned with a corner of the cell or one of the cell walls. The guide members or fingers are normally quite thin and have either a planar or slightly curved configuration such that they can be received in the cell without interfering with the bottle as it moves into the cell. When flexible members are utilized, the resiliency thereof causes same to normally be situated in a closed position. When the rigid members or fingers are utilized, same are spring loaded towards the closed position. In the closed position, the guide members or fingers converge and are downwardly and inwardly inclined such that the periperal edges of the extreme lower section of each of the guide members or fingers is in proximity to, in engagement with or in overlapping relationship with the peripheral edges of the extreme lower sections of the adjacent members, so as to form a generally hollow conical structure, usually having a blunt tip. The blunt tip is particularly disadvantageous when the partitions are grossly misaligned because the converged fingers cannot be easily inserted between partitions if same are nearly adjacent each other.

As the case is moved relative to the guide mechanism, immediately prior to the loading of the bottles therein, the hollow conical structure formed by the convergence of the lower sections of the four guide members is received into the aligned cell. As the conical structure is received in the cell, misalignment of the partitions which form the cell walls is corrected such that the partitions will not obstruct the path of the incoming bottle. The bottles are then released from the platform and dropped between the four guide members or fingers. The guide members or fingers, still in the closed position, act to guide the bottle into the cell in funnel-like fashion. As the bottle travels down the fingers, the guide members or fingers are caused to move apart until same are in an opened position, thereby guiding the bottle into the cell while further opening the partitions. In the opened position, the fingers are substantially vertical and thus, parallel to the cell walls. After the case is loaded, the case is moved downwardly relative to the guide mechanism withdrawing the fingers from the cell and thereafter the loaded case is removed from the case packer. Once the fingers clear the case, they return to the closed position—ready to assist in the loading of the next set of bottles into the next case.

The guide mechanism described above functions quite acceptably when long neck bottles are being packed. However, it has been found that such guide mechanisms do not perform reliably when used with wide mouth bottles or jars such as the type which are used as containers for mayonnaise, peanut butter, etc. Long neck bottles have a long, relatively small diameter neck which, with assistance from the guide members or fingers, is relatively easily insertable between the cell partitions, even if same are initially misaligned to a great extent. Because these bottles become wider gradually, the shape of the bottle itself assists in the alignment of the cell walls, as long as the leading portion of the bottle, the relatively thin neck, can be situated between the partitions.

However, this is not the case with wide mouth bottles. In bottles of this type, the mouth thereof is almost as wide as the remainder of the bottle. Thus, the rim of the mouth of such bottles, even when loaded with the guide mechanism described above, often engages the upper edge of one of the misaligned partitions, thereby either preventing insertion of the bottle into the cell or crushing the partition such that bottles in adjacent cells cannot be loaded therein, or a portion of the partition is torn and remains in the bottle.

Thus, it is particularly important, when wide mouth bottles are being loaded, that the guide members or fingers prevent the rims of the bottles from engaging the top edges of the partitions, as the bottle is loaded into the cell. In order to provide this function, it is necessary that the guide members or fingers be initially received in the cell to a depth sufficient to permit as much of the width of the finger to be situated within the cell as is possible. This assures that the rim of the bottle will be guided between the partitions. Further, it is advantageous to minimize the length of the fingers to reduce the distance through which the case must travel to the loading position. Thus, short, relatively wide fingers, which converge to form a suitably shaped structure to permit initial partition positioning, when the fingers are received in the cell, are optimum.

However, when the four finger configuration is employed, it is impossible to form the necessary structure upon convergence without substantial overlapping of the lower sections, if the fingers are short and wide. Overlapping of the lower sections of the fingers upon convergence creates problems because the fingers must be critically aligned relative to each other and designed such that complete convergence can be achieved without the fingers interfering with each other. In practice, this is difficult to achieve. Therefore, in order to eliminate overlapping but still permit convergence, the fingers are conveniently designed to be relatively long and narrow. Thus, a "trade-off" must take place because one cannot have long, narrow fingers, necessary to form the required partition opening structure, upon convergence, and short, wide fingers, necessary to prevent the rim from engaging the top of the partition, at the same time. However, when long neck bottles are being loaded, this problem is not serious because the former function is much more important than the latter, as the chances of the rim of the bottle engaging the top of the partition are quite small. Thus, conventional four-finger designs all utilize relatively long, narrow fingers. Such are quite suitable for long neck bottles but do not provide adequate protection against the rim engaging the edge of the partition when wide mouth bottles are packed.

It should be further noted that the cell must be as small as possible, as compared to the diameter of the bottle, to prevent movement of the bottle during shipment. Thus, the space between the bottle wall and the cell wall is extremely limited. Therefore, the fingers, in order to be present in the cell when the bottle is situated therein, must be either located at the corners of the cell or, if located parallel to the cell walls, be extremely thin. However, extremely thin fingers do not have sufficient rigidity to form the structure required to position the partitions as the fingers are initially received in the cell.

Moreover, because the fingers in the conventional four finger design must be relatively long, the amount of vertical space required for the packing operation is increased. As the case is conveyed horizontally to a position below the guide mechanism, the top of the case must clear the downwardly extending fingers. Thus, the length of the fingers determines the minimum distance between the top of the case and the grid support. As a consequence, the length of the fingers determines the vertical distance through which the case must travel in order to insert the fingers therein to the required depth. The smaller the fingers, the less distance the case has to travel relative to the support grid, the less the time required to move the carton to the appropriate loading position and the less the vertical space required to perform the entire packing operation.

The partition walls, particularly those associated with the outer cells adjacent the carton walls, have a tendency to be grossly misaligned prior to insertion of the bottles. In order to achieve insertion of the fingers into these cells, it is important that the structure formed when the lower sections of the fingers converge have a sharp tip and be as massive as possible. However, to permit the neck of the bottle to travel along the interior of the finger in funnel fashion and to permit the fingers to be withdrawn from the cell without engaging the bottle and withdrawing same, the interior surface of the finger must be free from obstructions. Thus, in a conventional four finger design, the lower portions of the fingers must be essentially flat, such that they converge to form a hollow structure with very little mass. Moreover, the lower edges of the fingers are normally blunt, thus forming a tip without a sharp point.

The conventional four finger structure also requires a relatively complicated mounting structure, particularly if a means for camming the bottles into the appropriate grid opening is provided above the grid surface. Such a feature may not be critical when long neck bottles are being packed, but, is extremely important when wide mouth bottles are being loaded.

It is, therefore, a prime object of the present invention to provide a guide mechanism for loading wide mouth bottles in cases wherein misalignment of the cell partitions is corrected and the wide mouth bottles are guided into the cell in a reliable fashion.

It is another object of the present invention to provide a guide mechanism for loading wide mouth bottles in cases wherein the guide mechanism comprises a grid support having only two guide members or fingers associated with each cell.

It is a further object of the present invention to provide a guide mechanism for loading wide mouth bottles in cases wherein the axial length of the guide members or fingers is relatively short, in order to reduce the vertical space required for the packing operation.

It is a still further object of the present invention to provide a guide mechanism for loading wide mouth bottles in cases wherein the full width of the finger can be initially received in the cell to prevent the rim of the bottle from engaging the edge of the partition.

It is a still further object of the present invention to provide a guide mechanism for loading wide mouth bottles in cases wherein more reliable alignment of the partitions is achieved through the formation of a solid pyramidal shaped structure when the fingers converge.

It is still another object of the present invention to provide a guide mechanism for loading wide mouth bottles in cases wherein the guide members or fingers themselves are fashioned to cam the bottles into the appropriate grid support opening.

It is still another object of the present invention to provide a guide mechanism for loading wide mouth bottles in cases wherein the guide members converge to form a structure with a relatively sharp tip to facilitate alignment of grossly misaligned partitions.

It is a still further object of the present invention to provide a guide mechanism for loading wide mouth bottles in cases wherein the interior surface of the fingers is shaped with a curvature corresponding to the curvature of the bottle.

It is a still further object of the present invention to provide a guide mechanism for loading wide mouth bottles in cases wherein the structure for mounting the fingers to the grid support is simple and operates reliably.

It is still a further object of the present invention to provide a guide mechanism for loading wide mouth bottles in cases wherein the mechanism comprises relatively few parts which are inexpensive to manufacture and to assemble and act together in a reliable and relatively maintenance-free fashion.

In accordance with the present invention, a guide mechanism for use in a case packer of the type which places a bottle or the like into a cell formed in the case by partitions is provided. The apparatus for guiding the bottle into the cell comprises a support and a pair of rigid guide members pivotally mounted, in opposing spaced relationship on the support. The guide members together define the sole partition engaging, bottle guiding structure. The guide members are movable between a closed mutually engaging position, inclined towards one another and an opened mutually separated, generally vertical position. Each of the members comprise a first section having a substantially planar interior surface facing the corresponding interior surface on the opposing member. The surfaces engaged in face-to-face relationship when the members are in the closed position. Means are provided for resiliently urging the members to the closed position. Means are provided for causing relative movement between the case and the support such that the converged first sections of the guide members are received into the cell to correct misalignment of the partitions.

The first section of each guide member also comprises two substantially planar exterior surfaces. The exterior surfaces and the interior surface taper to a common, relatively sharp point. This point is situated adjacent the point on the opposing member when the planar surfaces engage to form a common tip which is a part of the portion of the member received in the cell.

The exterior and interior surfaces define a body having a substantially half pyramidal shape. Thus, when the members converge, a substantially pyramidal shaped body is formed. This structure facilitates the proper positioning of the partitions, because of its shape, sharp tip and mass. In particular, the relatively sharp point facilitates the insertion of the converged fingers when the partitions are grossly misaligned.

The two exterior surfaces of the first section of the member join along an edge. The edge is adapted to be at least partially received in the corner of the cell when the first section of the member is inserted therein. This feature serves to further position the partitions. Moreover, the guide member is designed such that the dimension of the widest portion of the first section thereof substantially equals the distance between the respective points of contact of the bottle with adjacent cell walls. The members are received into the cell to a depth wherein the widest portion of each member is situated within the cell. In this manner, the rim of the incoming bottle is prevented from engaging the top of the partition.

Each of the guide members also has a second section which constitutes the remainder of the member. The second section has a concave interior surface. The concave surface is designed to have a curvature substantially corresponding to the curvature of the bottle wall, to facilitate guiding the bottle into the cell. The junction between the interior surfaces of the first and second sections is a curved edge. This curved edge extends between the peripheries of the widest portion of the first section.

The second section of the fingers also has a pair of substantially planar exterior surfaces. These exterior surfaces are extensions of the exterior surfaces of the first section.

On the exterior portion of the second section is located a bifuricated part. The support has mounted thereon an elongated part. The bifuricated part and elongated part each have an aperture therein. The elongated part is insertable into the bifurcated part such that the apertures align. A pin is received through the aligned apertures such that the member may pivot with respect to the support. A torsion spring surrounding at least a portion of the pin and operably engaging each of the parts is provided so as to urge the member toward the closed position.

In one embodiment, an elongated substantially planar element is mounted on and extends outwardly from one of the exterior surfaces of the second section of the member. This elongated element is situated along the exterior surface from which it extends, at a location thereon such that the bottom edge thereof engages the top of the partition when the first section of the member is received in the cell. This embodiment is particularly useful when wide mouth bottles, having a squared shape with rounded corners, such as is common in bottles in which orange juice and the like are sold, are being loaded. The planar element prevents the protruding shoulder of the squared corner from engaging the edge of the partition as the bottle moves into the cell.

To these and such other objects as may hereinafter appear, the present invention relates to a guide mechanism for loading wide mouth bottles in cases as described in the present specification and set forth in the appended claims, taken together with the accompanying drawings, wherein like numerals refer to like parts and in which:

Figure 1:
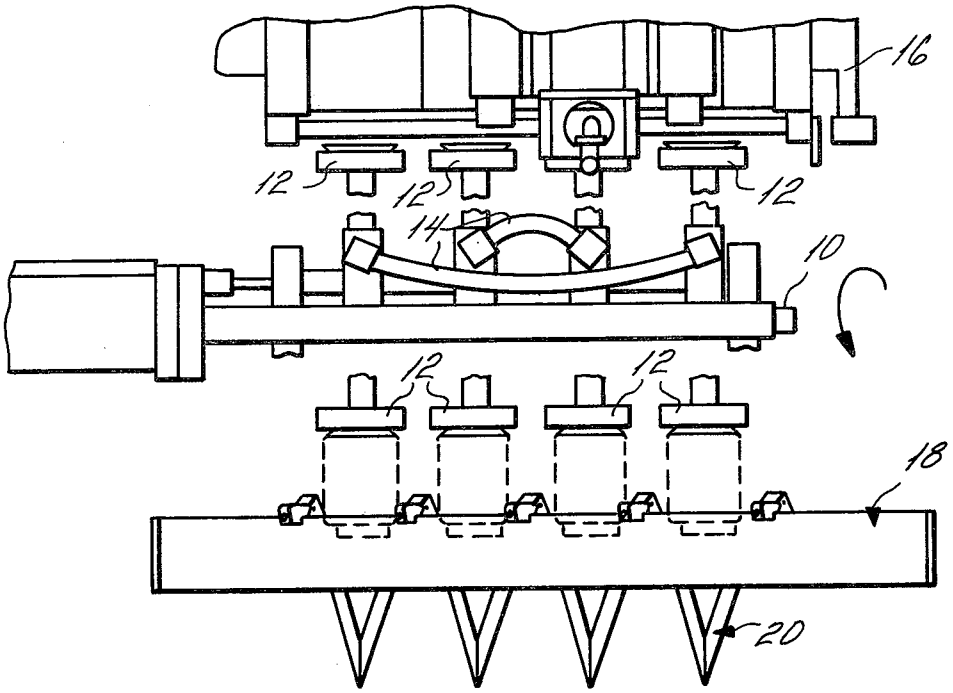
FIG. 1 is a side elevation view of the rotating loading platform of a case packer and the guide mechanism of the present invention useable therewith.

As shown in FIG. 1, a case packer, of the type which is utilizable in conjunction with the present invention, employs a rotatable platform 10 having a plurality (four are shown) of suction cups 12 mounted on the upper surface thereof. The suction cups 12 are connected by means of conduits 14 to a vacuum source, not shown. In its initial rotational position, platform 10 is oriented such that suction cups 12 are situated facing upward below a distribution member 16, which receives incoming bottles from the bottle conveyor, not shown. The distribution member 16 serves to position the incoming bottles such that each bottle is aligned with one of the suction cups 12. The bottom or floor of the distribution member 16 is equipped with a horizontally displaceable grid (not shown) and is movable between a first position wherein the bottles are prevented from dropping onto the suction cups and a second position wherein the bottles are permitted to fall onto the suction cups. Thus, after the distribution member 16 is loaded, the grid is moved from the first position to the second position to permit the bottles situated therein to fall onto their respective suction cups.

The bottles are loaded onto the respective suction cups with the bottoms thereof facing the cups. The vacuum system is actuated in order to hold the bottles on the cups. Thereafter, platform 10 is rotated by a motor (not shown) about a horizontal axis, as shown by the arrow, such that the bottles are suspended from suction cups 12 with the mouths thereof facing downward, as shown in the lower half of the drawing. In this position, the bottles are suspended immediately above the guide mechanism of the present invention which comprises support grid 18 from which are suspended a plurality of guide members or fingers 20. A case is vertically moved toward the grid 18 until fingers 20, in the converged position as shown, are received in the cells to align the partitions to receive the bottles. When the vacuum means is deactivated, the bottles are gravity fed through the grid and into the cells in a waiting case.

For simplicity, platform 10 is shown in FIG. 1 as having suction cups 12 on only one surface. However, it is preferable to have suction cups on both surfaces of rotatable platform 10, such that while bottles are being loaded onto the upper surface, the previously loaded bottles can be simultaneously discharged from the lower surface. In this manner, the time required for the loading operation is cut in half.

The mechanism disclosed in FIG. 1, with the exception of support grid 18 and guide fingers 20, forms no portion of the present invention and, therefore, has not been described in detail herein. However, for detailed information concerning the operation and structure of the case packer, the reader is referred to U.S. Pat. No. 3,694,993 issued Oct. 3, 1972 to Jerry L. East and entitled "Automatic Bottle Packing Method And Apparatus."

Figure 2:
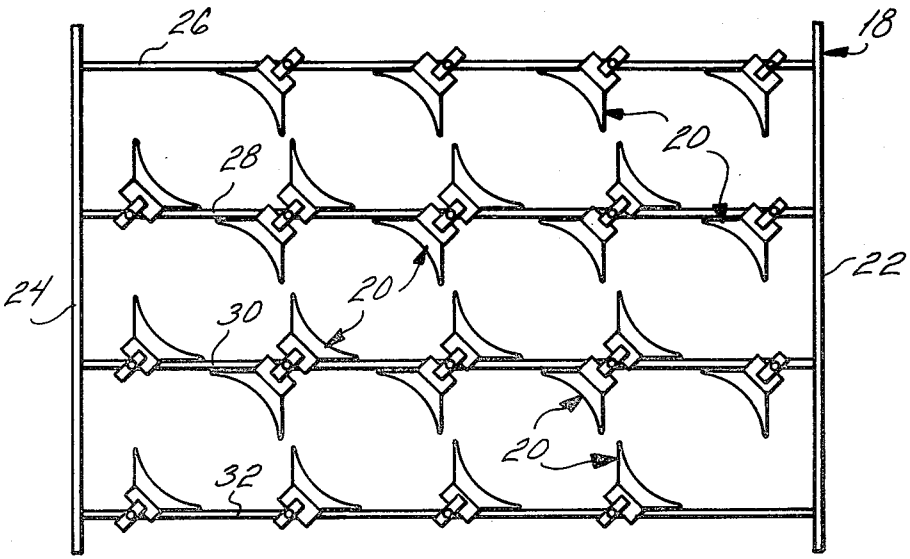
FIG. 2 is a top elevation view of the guide mechanism of the present invention.

As shown in FIG. 2, support grid 18 consists of a frame comprising a pair of upstanding side members 22, 24 connected by four parallelly situated cross members 26, 28, 30 and 34. The grid shown is designed for packing cases containing twelve bottles each and, therefore, has twenty-four guide members or fingers 20 mounted thereon, a pair of guide members or fingers 20 being provided for each cell. The guide fingers or members 20 in each pair are mounted on the cross members in opposing relationship, such that each member in the pair faces the other member of the pair. The guide members or fingers 20 are mounted on the cross members in alignment with opposing corners of the respective cells and each is mounted at a 45° angle with respect to the cross member. It should be noted that grid 18 contains no connecting members parallel to sides 22 and 24 within the bottle guiding area, such that the possibility of a bottle engaging such member is eliminated.

Figure 3:
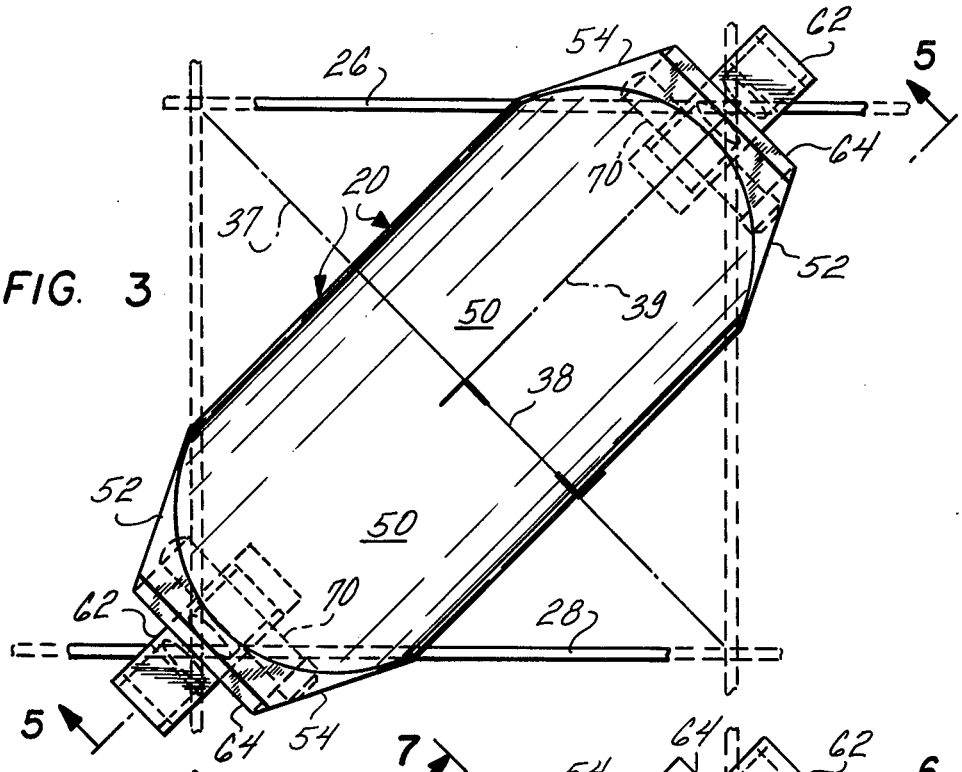
FIG. 3 is a top elevation view of the guide fingers of the present invention shown in the closed position.

FIG. 3 illustrates the spacial relationship between guide members or fingers 20 and the upstanding partitions which form the cell in the case. The partitions are normally made of corrugated paperboard or the like and are designed, in a well-known manner, with the appropriate slots (not shown) to permit interlocking between partitions to form the cells. FIG. 3 shows that the guide members or fingers 20 are aligned with opposing corners of the cell.

Figure 5:
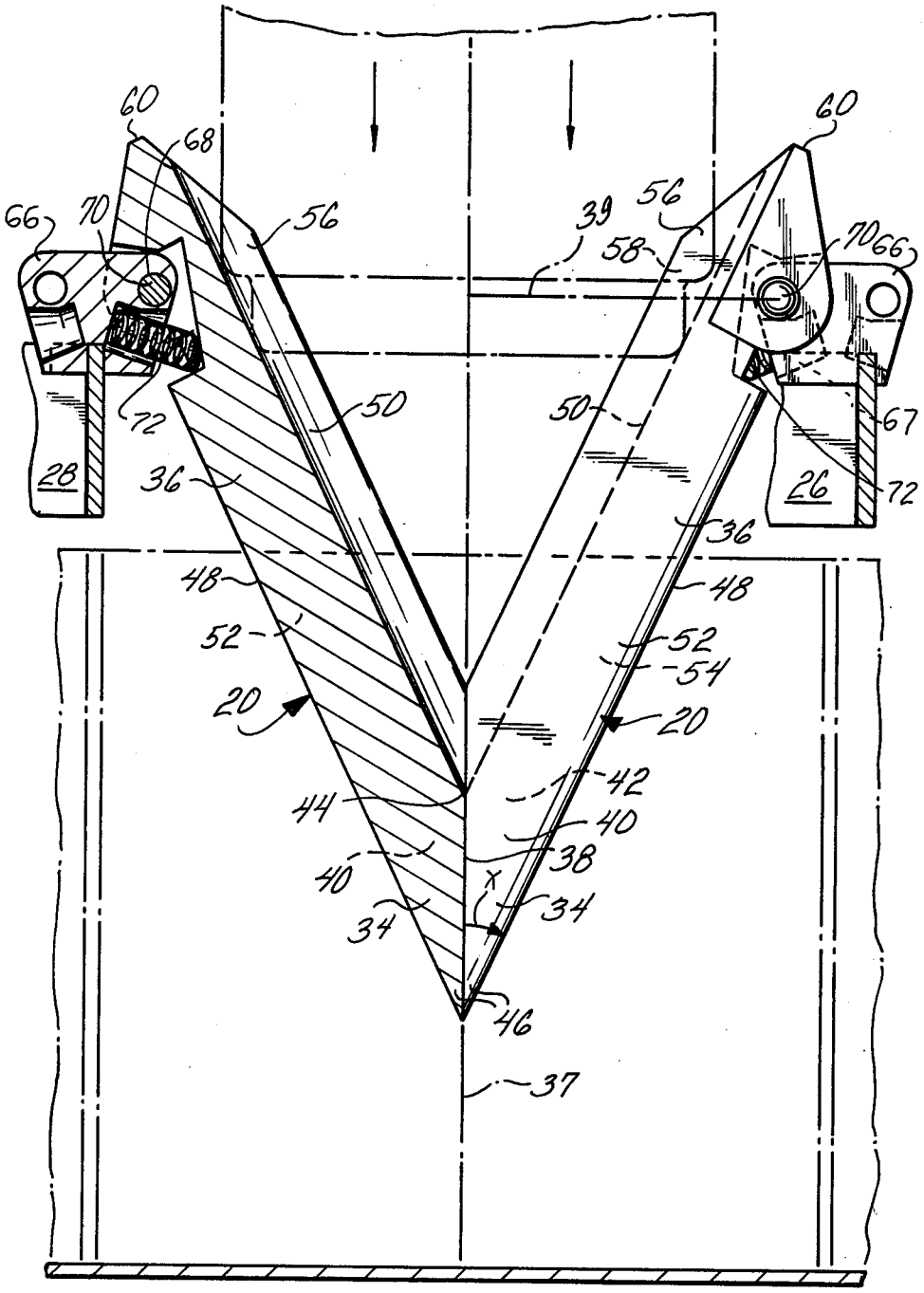
FIG. 5 is a side elevation view showing the fingers of the guide mechanism of the present invention as same are inserted into a cell.
Figure 7:
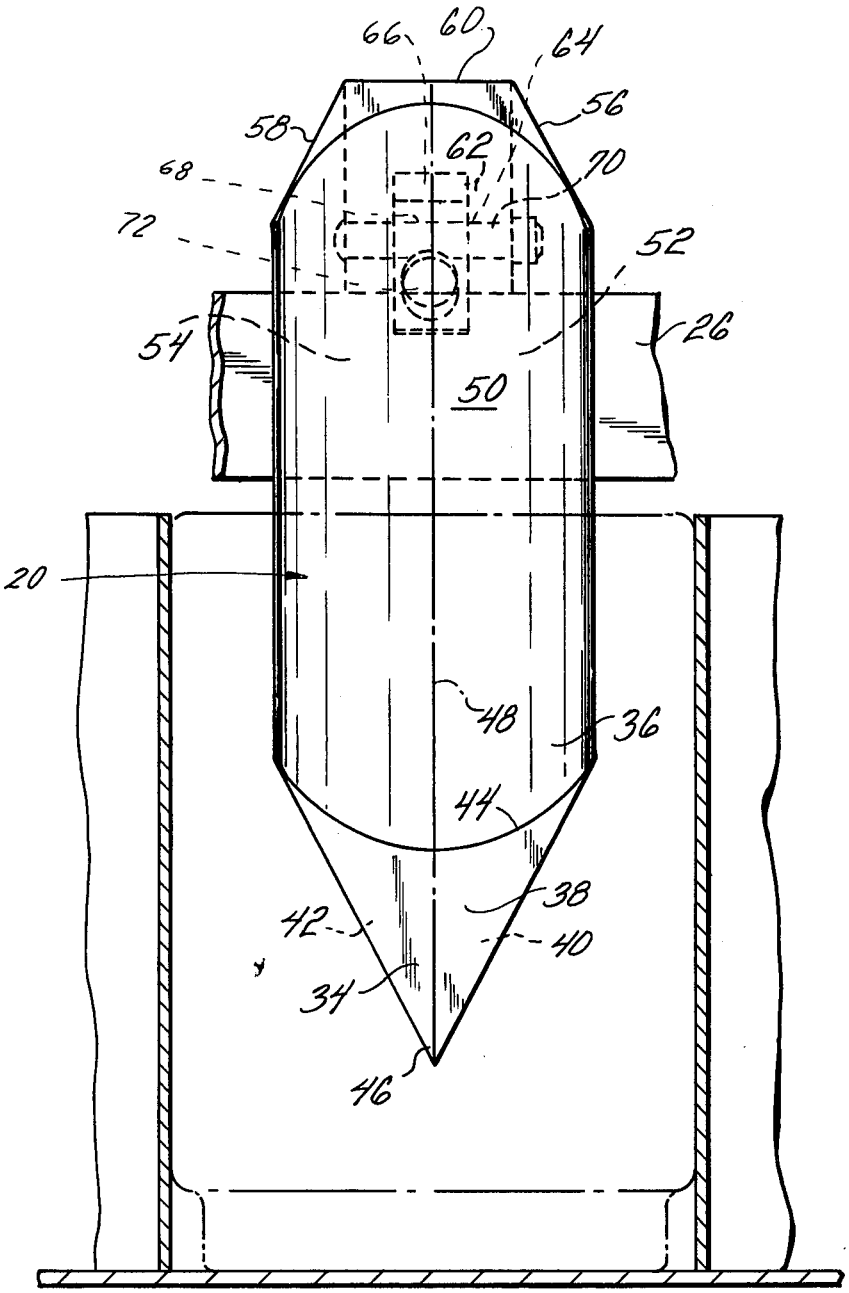
FIG. 7 is a front elevational view of one of the fingers of the guide mechanism of the present invention.

In FIGS. 3 and 5, the guide members or fingers 20 are shown in the closed or converged position. Each finger 20 comprises a lower section 34, which serves, upon convergence with the corresponding section of the other member of the pair, to form a partition positioning structure and an upper section 36 which forms the bottle guiding structure. Section 34 comprises an interior surface 38 and exterior surfaces 40 and 42. The interior surface 38 and exterior surfaces 40 and 42 each taper to a common, relatively sharp, point 46. Point 46 serves to facilitate insertion of the converged fingers between partitions which are nearly adjacent to each other when the partitions are grossly misaligned. The junction 44 between the lower portion 34 and the upper portion 36 has a curved configuration (as seen in FIG. 7) because of the concave shape of the interior surface of upper section portion 36.

The lower portion 34 of the guide member or finger 20, defined by surfaces 38, 40 and 42, is a solid, substantially half pyramidal shaped structure. When the lower sections 34 of opposing members engage as the members converge, as shown in FIGS. 3 and 5, the lower portions thereof combine to form a solid structure having a pyramidal shape with a relatively sharp tip which, when received in the cell, acts to correct any misalignment of the cell partitions such that the bottle can enter the cell.

Figure 4:
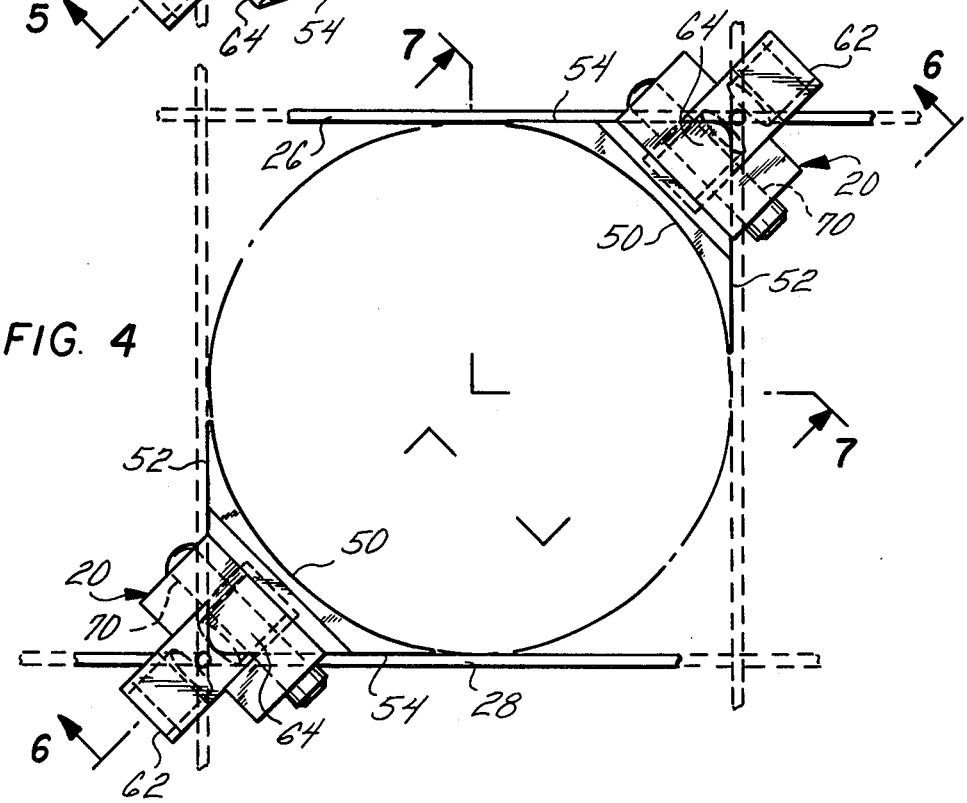
FIG. 4 is a top elevational view of the guide fingers of the present invention shown in the open position.

The two exterior surfaces 40 and 42 of the lower section 34 join along an edge 48. Edge 48 is adopted to be at least partially received in the corner of the cell when the member is inserted into the cell. Edge 48 acts to straighten the cell corner, and, therefore, the partitions which form the cell. It should also be noted that lower section 34, at its widest point, that is, along junction 44, substantially spans the distance between the respective points of contact of the bottle with the adjacent cell walls. This is best illustrated in FIG. 4, which shows the guide members or fingers 20 in the open position after the bottle is situated within the cell.

Each of the guide members or fingers 20 also comprises an upper section 36 which includes an interior surface 50 and exterior surfaces 52 and 54. Interior surface 50 has a concave configuration, the curvature of which is designed to conform to the curvature of the bottle wall. Interior surface 50 is a continuation of interior surface 38 of the lower section, but is formed at an angle with respect thereto, such that the lower portion 34 is situated so as not to obstruct the movement of the bottle into the cell or to interfere with the withdrawal of the fingers from the cell. This is best seen from FIG. 6. The curved edge or junction 44 comprises the boundary between the respective interior surfaces. Exterior surfaces 52 and 54 are extensions of and coplanar with exterior surfaces 40 and 42, respectively, from lower section 34.

As best seen in FIG. 7, the top portion of upper section 36 extends above the plane of grid 18 and is provided with a pair of inwardly tapering edges 56, 58. Edges 56 and 58 taper towards a flat top section 60, which constitutes the extreme upper edge of surface 50. The function of inwardly tapering edges 56 and 58 is to provide the necessary camming action to guide the bottles between the appropriate guide fingers, if the bottle should be so misaligned with respect to the cell, or become skewed after it is released from the suction cup, such that it would normally engage one of the cross members 26, 28, 30 or 32 of support grid 18 instead of passing therebetween. In this manner, inwardly tapering edges 56 and 58, which are mounted above the surface of grid 18, serve as the first means of positioning the bottle with respect to the guide fingers as the bottle approaches the support grid.

As seen in FIGS. 3 and 5, when the guide fingers 20 converge and are, therefore, situated in the closed position, the members are inclined towards one another and closely oppose one another, preferably mutually engaging one another, along the respective surfaces 38. The angle of inclination can vary depending upon the length of the finger and the dimensions of the cell. However, an angle of approximately 20° has been found to function satisfactorily. This angle permits the formation of the pyramidal structure upon convergence and, at the same time, as the fingers move to the open position, prevents the lower portions thereof from interfering with the incoming bottle and permits withdrawal of the fingers after the bottle is received in the cell. In the closed position, the corresponding interior planar surfaces 38 of the lower sections of each of the members engage in face-to-face relationship so as to form a solid, substantially pyramidal body which, as it is received in the cell, gradually acts to correct misalignment of the partitions to a sufficient degree to permit the members to be inserted therein to the appropriate depth.

Figure 6:
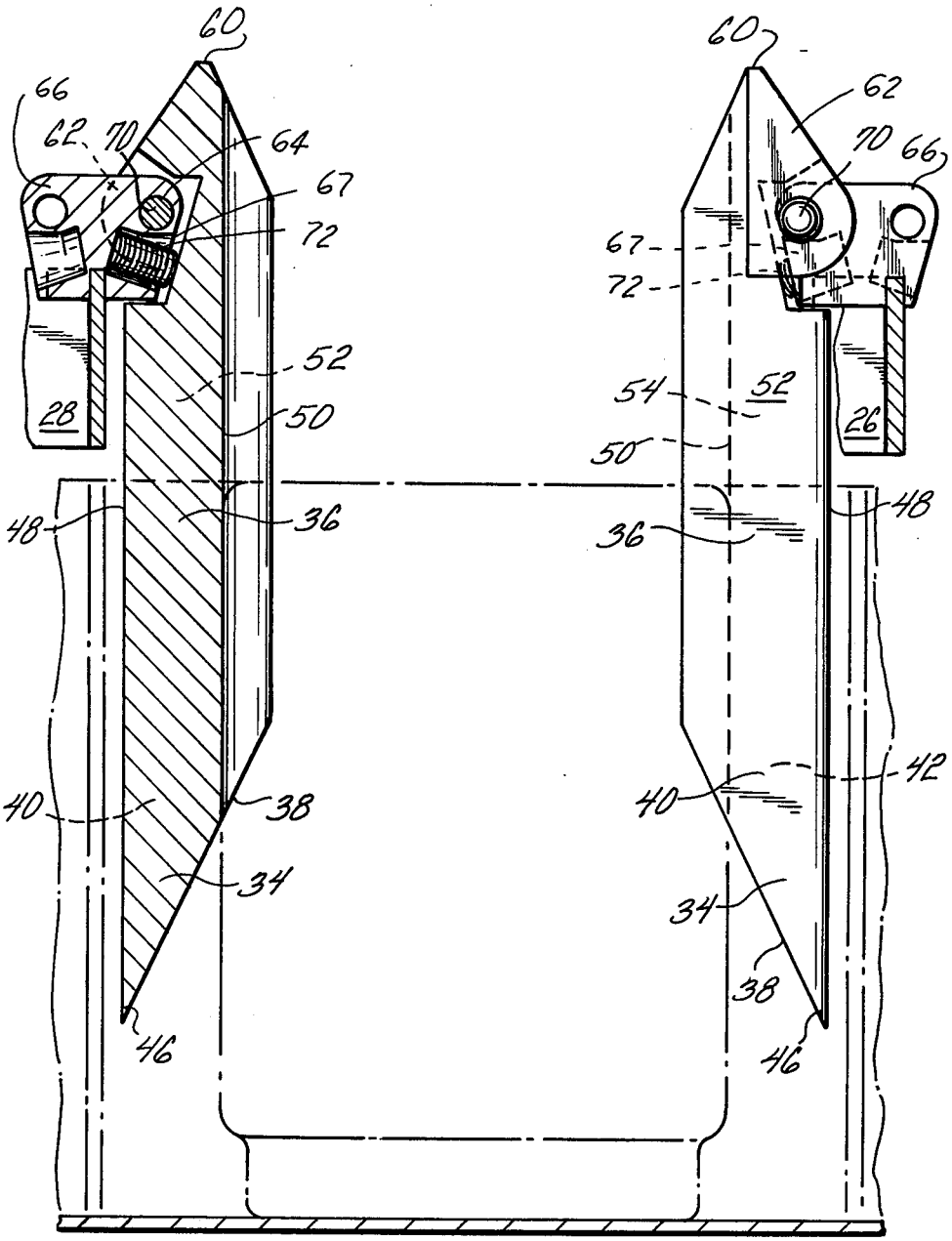
FIG. 6 is a side elevation view of the fingers of the guide mechanism of the present invention showing same after the bottle has been inserted into the cell.

Thereafter, the bottle released from the suction cups passes between the mutually engaging guide members such that same are moved to an opened, mutually separated, generally vertical position, as depicted in FIGS. 4 and 6. As this occurs, the partitions are further straightened and the bottle is received in the cell such that the open mouth thereof rests on the floor of the cell. As can clearly be seen by FIG. 6, in the open position, guide members 20 are situated in a substantially vertical position. In this position, the members can be withdrawn from the cell without withdrawing the bottle.

Each of the members 20 is provided with a rearwardly extending bifuricated part 62 which, when viewed from the top, as in FIGS. 3 and 4, appears to be "U"-shaped, and when viewed from the side, has a rounded configuration which tapers towards surface 60 at the extreme top of the upper section 38. Each section of bifuricated part 62 is provided with an aperture 64 therethrough. Each of the cross members 26–32 are provided, at the appropriate location thereon, with a protruding elongated part 66 which, as best seen in FIG. 7, is receivable between the two sections of bifuricated part 62. Elongated part 66 is fixedly mounted to the cross-members 26–32 by welding or other appropriate means at an angle of 45° with respect to the plane of the cross member, orienting the finger 20 mounted thereon to be situated in alignment with a corner of a cell, such that the exterior surfaces 52 and 54 are substantially parallel with the partitions which go to make up the walls of the cell.

Elongated portion 66 is also provided with an aperture 68 therethrough. When bifuricated part 62 is correctly positioned with respect to elongated part 66, apertures 64 and 68 are in alignment such that a pin 70 can be inserted therethrough in order to form a pivotal connection between member 20 and its associated cross-member. The pivotal connection permits movement of the member 20 with respect to the cross member to which it is situated between the closed position, as illustrated in FIG. 5 and the open position as illustrated in FIG. 6. A compression spring 72, receivable within a recess 67 in elongated part 68, 66 designed for this purpose, extends towards and engages the rear of member 20. Thus, one end of spring 72 operably engages member 20 and the other end engages the elongated part 68 of the associated cross member, such that the members 20 are continuously urged towards the closed position, as shown in FIG. 5. Therefore, the movement of the bottle into the cell, which causes members 20 to move towards the open position, as shown in FIG. 6, compresses spring 72. As soon as the members are withdrawn from the cell, the members return to the closed position, as shown in FIG. 5, through the action of compression spring 72.

The length L of the member, defined as being the distance between tip 46 and the axis of pin 70, is a function of the size of the cell and the angle which interior surface 38 of lower part 34 makes with edge 48. (The length L is calculated below as if the axis of pin 70 were co-linear with the line extending from edge 48 along the rear of the member. However, as shown in the drawings, the axis of pin 70 is actually slightly offset from this line and, therefore, the calculations below are only approximate.)

Assuming that the upstanding partitions in the case define cell walls of equal dimension D, that is, a square cell, then the diagonal of the cell has a dimension equal to $D\sqrt{2}$. When in the closed condition, interior surface 38 of the lower portion 34 is situated in a plane 37 (see FIG. 3) which bisects the cell and passes through opposing corners of the cell which are not aligned with members 20. The distance 39, therefore, from plane 37 to the corner aligned with the mounted member is half the length of the diagonal or $D\sqrt{2}/2$.

The angle which the plane 37 makes with edge 48 is designated as X (see FIG. 5). The length L of the member, along edge 48, from the tip 46 of the member to the axis of pin 70, can, therefore, be calculated by imagining a right triangle superimposed over the member as it is seen, for instance, in FIG. 5, such that acute angle X is situated at tip 46, the hypotenuse of the triangle is coincident with edge 48 (extended to the axis of pin 70), the second acute angle is situated on the axis of pin 70 and the right angle is situated at the intersection of the plane 37 and the perpendicular line 39 passing through the axis of each of the pins 70 on the opposing members. From trigonometry, it is known that in a right triangle, the sine of an angle is equal to the length of the opposite side, divided by the length of the hypotenuse. Since the opposite side, in this case line 39, has a length equal to $D\sqrt{2}/2$, the sine of angle X equals:

$$\text{SINE } X = D\sqrt{2}/2L.$$

Solving for L:

$$L = D\sqrt{2}/(2 \text{ SINE } X)$$

It will therefore be appreciated that once the size of the cell is determined, the length of member 20 is dependent upon the size of the angle between surface 38 and edge 48. Thus, with the proper design, it is possible to have a short, relatively wide finger which will minimize the vertical space required to perform the loading operation and, at the same time, prevent the rim of a wide mouth bottle from engaging the periphery of the partition as the bottle moves into the cell.

Figure 8:
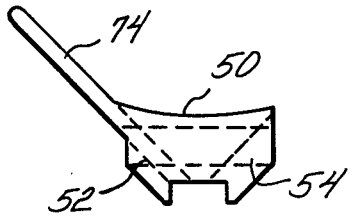
FIG. 8 is a top elevational view of a second embodiment of a finger of the guide mechanism of the present invention.
Figure 9:
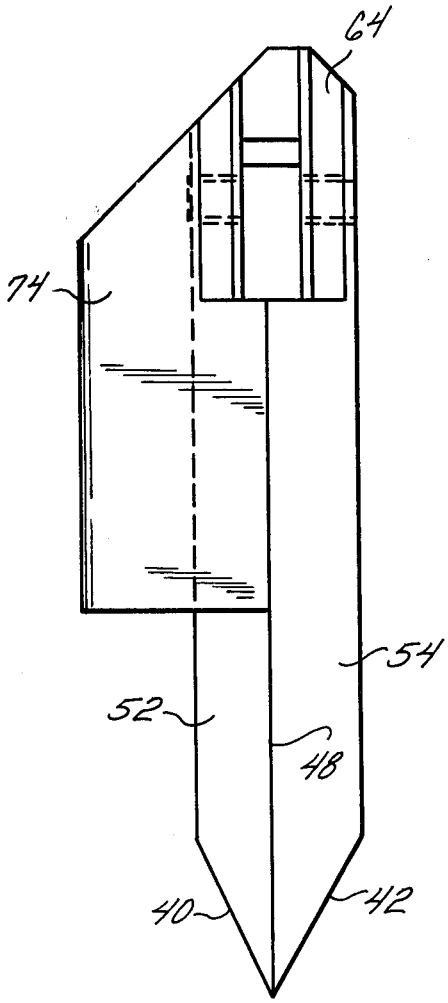
FIG. 9 is a front elevational view of the second embodiment of the finger of the guide mechanism of the present invention.
Figure 10:
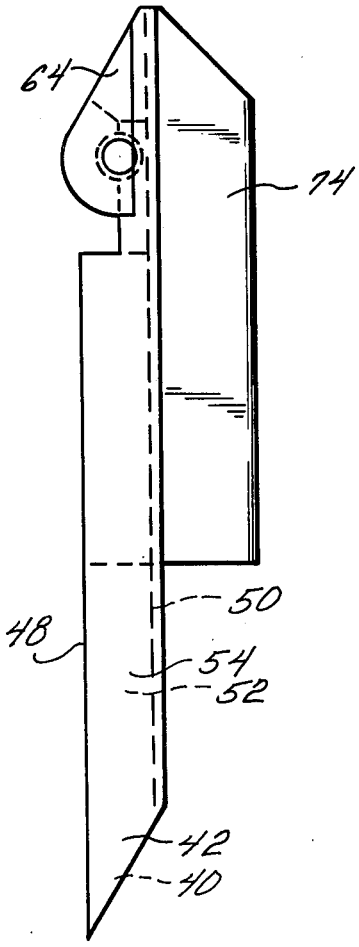
FIG. 10 is a side elevational view of the second embodiment of the finger of the guide mechanism of the present invention.

FIGS. 8, 9 and 10 illustrate a second preferred embodiment of the present invention. The second preferred embodiment is identical to the embodiment described above, with the exception of an additional elongated planar member 74, which extends outwardly from exterior surface 52. Member 74 does not, however, extend along the entire axial length of the member but terminates at the intermediate portion of the member, at the point located adjacent the upper edge of the partition when the member is fully received in the cell. Thus, when the member is fully received in the cell, the lower edge of member 74 rests on the upper edge of the adjacent partition. The second preferred embodiment is particularly useful when "square" wide-mouthed bottles are being loaded. The term "square" herein is used to mean a bottle with substantially planar sides of approximately equal dimension but with curved or rounded corners, as in common containers in which orange juice is sold. The corners protrude outwardly of the rim of the bottle and therefore tend to engage the upper edge of the partition as the bottle is received in the cell.

The extended member 74 prevents the protruding rounded corners of the square bottle from engaging the upper peripheral edge of the partition by, in effect, forming an upwardly directed extension of the partition, such that the corner of the "square" bottle is already situated between the extended members 74 of opposing fingers 20 prior to the entrance of the corner into the cell. In this manner, the extended members 74 prevent the corner, which protrudes radially outward of the rim of the bottle, from engaging the edge of the partition.

As now will be readily appreciated, the present invention relates to a guide mechanism for loading wide mouth bottles in cases wherein the guide mechanism comprises a grid support and only two guide members or fingers associated with each cell. The axial length of the guide members is relatively short in order to reduce the vertical space required for the packing operation. However, the design of each of the fingers is such that the full width of the finger can be initially received in the cell to prevent the rim from the bottle from engaging the edge of the partition.

The fingers are provided with camming surfaces situated above the plane of the grid support so as to guide the bottles towards the appropriate openings in the grid support as same are released from the rotatable platform. Upon convergence of the fingers, a solid pyramidal shape structure, having a relatively sharp tip, is formed which is received in the cell in order to correct any misalignment of the partitions. Because of the shape and mass of the structure and the relatively sharp tip, initial positioning of the partitions is facilitated, even if the partitions are grossly misaligned. The interior surface of the fingers is shaped with the curvature corresponding to the curvature of the bottle, in order to guide the bottle into the cell. Further, the fingers are mounted to the support in a spring loaded fashion by means of a simple mechanism which operates reliably.

While only two preferred embodiments of the present invention have been disclosed herewith for purposes of illustration, it is obvious that many variations and modifications could be made thereto. It is intended to cover all of these variations and modifications which fall within the scope of the present invention, as defined by the following claims.

I claim:

1. For use in a case packer of the type which places a bottle or the like into a cell formed in the case by partitions, apparatus for guiding a bottle into the cell comprising: a support, a pair of rigid guide members pivotally mounted on said support in opposing spaced relationship, said pair of guide members together defining the sole partition-positioning, bottle-guiding means and being movable between a closed mutually closely opposed position, inclined towards one another, and an opened mutually separated, generally vertical, position; each of said members comprising a first section having a substantially planar interior surface facing a corresponding interior surface on the other member, said surfaces closely opposing one another in face-to-face relationship when said members are in said closed position, and means for resiliently urging said members to said closed position.

2. The apparatus of claim 1, wherein said first section further comprises two exterior surfaces, said exterior surfaces and said interior surface tapering to a common point, said point being situated adjacent the point on the opposing member when said planar survaces engage, to form a common tip, said common tip forming a part of said received first sections.

3. The apparatus of claim 1, wherein said exterior surfaces are substantially planar.

4. The apparatus of claim 2, wherein said exterior and interior surfaces define a body having a substantially half pyramidal shape.

5. The apparatus of claim 1, wherein said first section has a substantially half pyramidal shape.

6. The apparatus of claim 1, wherein said first sections of said two members when said members are closely opposed form a substantially pyramidal shaped structure.

7. The apparatus of claim 1, wherein said members, when in said closed position, are inclined downwardly and inwardly from the vertical by approximately 20 degrees.

8. The apparatus of claim 1, wherein said first section further comprises two exterior surfaces joined along an edge, said edge being adapted to be at least partially received in the corner of the cell, when said first section is inserted in the cell.

9. The apparatus of claim 1, wherein the widest portion of said first section substantially spans the distance between the respective points of contact of the bottle with adjacent cell walls.

10. The apparatus of claim 1, further comprising a second section, the junction between the interior surfaces of said first and second sections being a curved edge.

11. The apparatus of claim 10, wherein said curved edge extends between the peripheries of the widest portion of said first section.

12. The apparatus of claim 1, further comprising a second section, said second section comprising a concave interior surface, said concave surface having a curvature substantially corresponding to the curvature of the bottle wall.

13. The apparatus of claim 12, wherein said second section further comprises substantially planar exterior surfaces, said exterior surfaces of said second section being extensions of the exterior surfaces of said first section.

14. The apparatus of claim 12, wherein said interior surface of said first section and said concave surface of said second section join along a curved edge.

15. The apparatus of claim 12, wherein said second section has a pair of inwardly tapering edges.

16. The apparatus of claim 15, wherein said tapering edges are spaced along said second section from said first section.

17. The apparatus of claim 1, further comprising means for mounting said member to said support, said mounting means comprising a bifuricated part extending from said member and an elongated part extending from said support, each of said parts having an aperture therein, said elongated part being received into said bifuricated part such that said apertures align and a pin insertable through said aligned apertures to form a pivotal connection therebetween and wherein said urging means comprises a spring operably engaging said member and said elongated part so as to urge said member to said closed position.

18. The apparatus of claim 1, said members each further comprising a second section having a curved interior surface and a substantially planar exterior surface, an elongated substantially planar element mounted on and extending outwardly of said exterior surface, said element being situated on said exterior surface at a location thereon such that the bottom edge thereof engages the top of the partition when said first sections are inserted into the cell.

19. For use in a case packer of the type which places bottles or the like into a cell formed in the case by partitions, apparatus for guiding a bottle into the cell comprising: a support, a pair of rigid guide members pivotally mounted on said support in opposing spaced relationship, said pair of guide members together defining the sole partition-positioning, bottle guiding means and being movable between a closed mutually closely opposed position inclined towards one another and an opened mutually separated, generally vertical position, each of said members comprising two substantially planar exterior surfaces forming an edge adapted to be at least partially received in the corner of the cell and a substantially concave interior surface, said interior surface having a curvature substantially the same as the curvature of the outside wall of the bottle, and means for resiliently urging said members to said closed position.

20. The apparatus of claim 19, wherein each of said exterior surfaces has a maximum width substantially equal to the distance between the point of contact of the bottle with the cell wall and the adjacent corner of the cell.

21. The apparatus of claim 19, wherein each of said exterior surfaces is substantially parallel to the wall of the cell aligned therewith when said member is in said opened position.

22. The apparatus of claim 20, wherein each of said exterior surfaces is substantially parallel to the wall of the cell aligned therewith when said member is in said opened position.

23. The apparatus of claim 19, wherein each of said exterior surfaces has an inwardly tapering edge.

24. The apparatus of claim 19, wherein each of said members comprises a substantially half pyramidal section, said half pyramidal sections engaging, when said members are in said closed position, to form a substantially pyramidal shaped structure.

25. The apparatus of claim 24, wherein said half pyramidal section has an interior surface with a curved edge, said edge forming a junction with said concave surface.

26. The apparatus of claim 25, wherein said curved edge extends between the extremities of said member.

27. The apparatus of claim 25, wherein said interior surface with said curved edge engages the corresponding surface on the opposing member, when said members are in the closed position.

28. The apparatus of claim 19, wherein said members, when in said closed position, are inclined downwardly and inwardly from the vertical by approximately 20 degrees.

29. The apparatus of claim 19, further comprising an elongated substantially planar element mounted on and extending outwardly of one of said exterior surfaces of same members, said element being situated on one said exterior surface at a location therein such that the bottom edge thereon engages the top of the partition when said first sections are inserted into the cell.

30. The apparatus of claim 19, wherein each of said members further comprises a bifuricated part and said support comprises an elongated part, each of said parts having an aperture therein, said elongated part being received into said bifuricated part such that said apertures align, a pin insertable through said aligned apertures and wherein said urging means comprises a compression spring operably engaging said member and said elongated part so as to urge said member to said closed position.

31. For use in a case packer of the type which places wide mouth bottles or the like into a substantially square cell having a peripheral dimension D, formed in a case by partitions, apparatus for guiding a bottle into the cell comprising a support, a pair of guide members pivotally mounted on said support at points thereon substantially aligned with respective opposing corners of said cell, said members being movable between a closed mutually closely opposed position and an open mutually separated position and each having an axial length L extending from said pivot point to the tip of said member, said length being situated along an edge substantially co-linear with the corner of the cell aligned therewith when said member is in said opened position, and a surface extending from said top at an acute angle X from said edge, said surface, when said member is in said closed position, being substantially situated in the plane bisecting the cell and passing through the corners thereof other than those aligned with said edges of said members, said surfaces of said members engaging one another when said members are in said closed position, and means for resiliently urging said members to said closed position.

32. The apparatus of claim 31, wherein said edge has a length L, wherein L is approximately equal to:

$$L = D\sqrt{2}/(2 \text{ SINE } X).$$

33. The apparatus of claim 31, wherein X is approximately 20 degrees.

34. For use in a case packer of the type which places bottles or the like into a cell formed in the case by partitions, apparatus for guiding a bottle into the cell comprising: a support; a pair of rigid guide members pivotally mounted on said support, each of said members being in alignment with an opposite corner of the cell, said members being movable between a closed position and an open position, each of said members comprising an exterior surface including first and second substantially planar faces joined to form an edge, said edge being adapted to be received in said aligned corner of the cell, and an interior surface having first and second sections, said first section having a curved edge and a pair of substantially straight edges tapering to a point from the extremities of said curved edge so as to form an interior surface, said interior surface closely opposing the corresponding interior surface on the opposing member so as to form a substantially pyramidal shaped structure when aid members are in the closed position, said second section comprising a substantially concave interior surface substantially corresponding to the shape of the outer surface of the bottle and adapted to be in a position substantially parallel to the outer surface of the bottle when said members are in said open position, said concave surface substantially surrounding said outer surface of said bottle between the points thereon which contact adjacent sides of said cell; and, means for urging said members towards the closed position.

* * * * *